US005674371A

United States Patent [19]

Patel

[11] Patent Number: 5,674,371

[45] Date of Patent: Oct. 7, 1997

[54] PROCESS FOR ELECTROLYTICALLY TREATING ALUMINUM AND COMPOSITIONS THEREFOR

[75] Inventor: Pinakin Patel, Fort Mill, S.C.

[73] Assignee: Clariant Finance (BVI) Limited, Tortola, Virgin Islands (Br.)

[21] Appl. No.: 466,304

[22] Filed: Jun. 6, 1995

Related U.S. Application Data

[63] Continuation of Ser. No. 345,152, Nov. 28, 1994, abandoned, which is a continuation of Ser. No. 180,177, Jan. 11, 1994, abandoned, which is a continuation of Ser. No. 906,775, Jun. 30, 1992, abandoned, which is a continuation of Ser. No. 601,474, Oct. 19, 1990, abandoned, which is a continuation-in-part of Ser. No. 433,498, Nov. 8, 1989, abandoned.

[51] Int. Cl.[6] ..... C25D 11/22

[52] U.S. Cl. ..... 205/105; 205/173; 205/174; 205/241

[58] Field of Search ..... 205/105, 173, 205/174, 241, 50

[56] References Cited

U.S. PATENT DOCUMENTS

| | | | |
|---|---|---|---|
| 3,634,208 | 1/1972 | Kuroda | 205/50 |
| 3,787,295 | 1/1974 | Endinger et al. | 205/173 |
| 4,022,671 | 5/1977 | Asada | 205/174 |
| 4,179,342 | 12/1979 | Walsh | 205/105 |
| 4,180,443 | 12/1979 | Darrow | 205/173 |
| 4,251,330 | 2/1981 | Sheasby et al. | 205/173 |
| 4,310,586 | 1/1982 | Sheasby et al. | 428/220 |
| 4,421,610 | 12/1983 | Rodriguez | 205/175 |
| 4,798,656 | 1/1989 | Paulet | 205/105 |

OTHER PUBLICATIONS

W. W. E Hubner and A. Schiltknecht, *The Practical Anodizing Of Aluminum*, MacDonald & Evans, London, 1960, pp. 21–29 no month available.

*Primary Examiner*—Kathryn L. Gorgos
*Assistant Examiner*—William T. Leader
*Attorney, Agent, or Firm*—Robert S. Honor; Carl W. Battle; Diane E. Furman

[57] ABSTRACT

A process for providing a variety of light to medium colors of anodized aluminum or aluminum alloy which comprises the steps of anodizing an aluminum or aluminum alloy workpiece in an aqueous strong acid electrolyte solution such as a sulfuric acid solution by application of direct current at a current density of 5 to about 25 amperes per square foot and a temperature of from 55° F. to 90° F. to form on the workpiece a porous anodic oxide film having a thickness of at least about 3 microns; subjecting the resulting anodized workpiece to alternating current at a voltage of about 5 to about 25 volts for about 1 to 25 minutes in an aqueous strong acid electrolyte solution such as a sulfuric acid solution comprising about 1 to 15 volume percent of an organic carboxylic acid containing at least one reactive group in the alpha-position, wherein said reactive group is a hydroxy, amino, keto or carboxyl group; and electrolytically coloring the workpiece. In a preferred embodiment resulting in deepened color tones, including those in the blue to blue-gray and green range, one or more currentless "waiting periods" are maintained at various stages of the process during which essentially no current is applied to the workpiece in the electrolytic solution. In another embodiment, improved color uniformity is obtained by subjecting the workpiece prior to electrolytic coloring to a direct current pre-treatment step. The resulting electrolytically colored aluminum or aluminum alloy is particularly useful for architectural product.

25 Claims, No Drawings

PROCESS FOR ELECTROLYTICALLY TREATING ALUMINUM AND COMPOSITIONS THEREFOR

This is a continuation of application Ser. No. 08/345,152, filed Nov. 28, 1994, now abandoned, which in turn is a continuation of application Ser. No. 08/180,177, filed Jan. 11, 1994, now abandoned, which in turn is a continuation of application Ser. No. 07/906,775, filed Jun. 30, 1992, now abandoned, which in turn is a continuation of application Ser. No. 07/601,474, filed Oct. 19, 1990, now abandoned which in turn is a continuation-in-part of application Ser. No. 07/433,498, filed Nov. 8, 1989, now abandoned.

BACKGROUND OF THE INVENTION

The present invention relates to a method for anodizing and electrolytically coloring aluminum and aluminum alloys, and to compositions useful therein.

Various electrolytic coloring processes have been developed, and can be viewed as fundamentally "two-stage" processes involving an anodizing stage followed by an electrolytic coloring stage.

In the anodizing step, the aluminum workpiece is electrolyzed under conditions to result in the formation of a surface aluminum oxide coating (commonly referred to as an "anodic oxide film"). The electrolysis is generally performed by applying direct current to the aluminum workpiece serving as the anode in an electrolytic bath wherein a second metal source, such as aluminum, or graphite, serves as the cathode. An aqueous strong acid electrolyte such as sulfuric acid is generally employed to provide anodic oxide film of satisfactory hardness, corrosion resistance and coloring ability.

The resulting anodic oxide film comprises an inner protective "barrier" layer which is dielectric, thin (i.e. about 0.1–1 micron), strong, and pore-free; and a nondielectric outer layer, of greater thickness (i.e. from about 3 to 100 or more microns) which to varying degrees depending on the conditions of anodization is characterized by a pattern of pores extending within the layer, see Hubner, W. W. E. and A. Schiltknecht, *The Practical Anodizing of Aluminum*, MacDonald & Evans, London (1960), pp. 21–29. The porous outer layer of the anodic oxide film provides a suitable substrate for deposition of coloring agents.

The second stage of the two-stage electrolytic coloring processes comprises electrolytic deposition of coloring agents, e.g., metal salts or mixtures thereof, into the pores of the anodic oxide film, typically in the presence of alternating current.

Various factors such as current density and duration, temperature and composition of the anodization and coloring baths, and specialized treatments may affect the morphology and properties of the resulting anodic oxide film and its coloring.

For example, depending on the current density in the anodizing step, the anodic oxide film which is produced varies from a "soft" or porous-type film to a "hard" dense film of lesser porosity. Generally, the porous anodic oxide film is obtained by anodizing at current densities not exceeding about 25 amperes per square foot (ASF) at ambient temperature, i.e. about 55° F. to 95° F. Anodizing at current densities above about 24 or 25 ASF under certain conditions provides hard, dense-type film of lesser porosity, the hardness varying with the anodizing temperature.

In U.S. Pat. Nos. 4,180,443 and 4,179,342, hard, dense-type anodic oxide coatings are produced at direct current densities of about 24 to 36 ASF at ambient temperature in an aqueous acid electrolyte comprising sulfuric acid, a polyhydric alcohol and an organic carboxylic acid. Such processes offer certain advantages in hard coating technology but nevertheless apparently provide only limited colors, i.e. deep red, bronze and black.

The present invention relates to improvements in porous anodic oxide film technology including, in particular, processes which provide a variety of light to medium colors of the anodized aluminum or aluminum alloy.

SUMMARY OF THE INVENTION

The process of the present invention comprises the steps of: (a) anodizing an aluminum or aluminum alloy workpiece in an aqueous electrolyte solution comprising about 90–300 grams per liter of a strong acid by application of direct current at a current density of about 5 to about 25 amperes per square foot and a temperature of from 55° F. to 90° F. to form on the workpiece a porous anodic oxide film having a thickness of at least about 3 microns; (b) subjecting the resulting anodized workpiece to alternating current at a voltage of about 5 to about 25 volts for about 1 to 25 minutes in an aqueous electrolyte solution comprising 120–250 grams per liter of a strong acid and from about 1 to 15 volume percent of an organic carboxylic acid containing at least one reactive group in the alpha-position, wherein said reactive group is a hydroxy, amino, keto or carboxyl group; and (c) coloring the workpiece by subjecting it to substantially alternating current in an aqueous electrolyte solution comprising at least one metal salt as a coloring agent.

In certain preferred embodiments of the invention, a "waiting period" is maintained at one or more stages in the above process, during which essentially no current is passed to the workpiece in the electrolyte solution. It has been found that such "currentless" waiting periods advantageously can provide deeply colored product which is particularly suitable for architectural applications.

In a further embodiment of the invention resulting in product of improved color uniformity, the workpiece prior to electrolytic coloring (step (c)) is subjected to a pre-treatment which comprises application of substantially direct current thereto.

DETAILED DESCRIPTION OF THE INVENTION

The anodization step may be preceded by known pretreatments of the aluminum workpiece such as by rinsing and degreasing, e.g., with hot trichloroethylene or trisodium phosphate, and etching, e.g., with caustic soda.

The anodization is performed by conventional means generally known in the art. The aluminum workpiece, which is adapted to serve as the anode of a power source, is immersed in an electrolyte bath, together with another metal source, preferably also aluminum, or graphite, which serves as the cathode. Direct current is applied to the workpiece for a time and under conditions suitable for formation of the anodic oxide film.

The anodizing bath comprises an aqueous strong acid electrolyte, preferably selected from sulfuric acid, phosphoric acid, and mixtures thereof. A sulfuric acid-based electrolyte is most preferred, because it provides film of "architectural quality," i.e. having suitable hardness, thickness, and corrosion resistance for outdoor use.

Other acids often employed in certain anodizing processes, e.g., chromic or oxalic acid, are less preferred, although minor amounts of such acids or others may optionally be present in the preferred sulfuric or phosphoric acid-based electrolytes.

The acid concentration in the aqueous electrolyte bath is from about 90–300 grams per liter of bath and more preferably, 120–250 grams per liter of bath.

It is advantageous that a certain amount of aluminum also be present in the anodizing bath, which can be provided by the addition of suitable aluminum compounds, such as aluminum sulfate. The amount of aluminum which is present in the bath is about 1–10 g/liter, preferably 1–5 g/liter.

Direct anodic current is applied to the workpiece at a current density of about 5 to about 25 ASF, more preferably 10–20 ASF, and even more preferably 15–20 ASF.

The term "direct current" as used herein shall be understood to comprise not only direct current in the strict sense of the term but also other essentially identical currents such as, e.g., those produced by fullwave rectification of single-phase alternating current or by rectification of three-phase alternating current.

The anodization bath is desirably maintained at about room temperature, i.e. 55°–90° F., preferably about 65°–75° F., and more preferably about 68°–72° F., and therefore it may be necessary to employ devices to regulate the temperature of the bath during anodization.

In the process of the present invention, anodizing conditions are preferably selected to provide a porous anodic oxide film of about 20–30 microns thickness, and it will be within the skill of the practitioner in the art to obtain such film by practicing within the scope of the present invention.

According to the process of the invention, the resulting anodized aluminum or aluminum alloy workpiece is then subjected to an alternating current (AC) in an aqueous strong acid electrolyte solution which comprises about 1 to 15, preferably about 1–10, volume percent of an organic carboxylic acid containing at least one reactive group in the alpha-position to a carboxyl group therein, wherein said reactive group is a hydroxy, amino, keto or carboxyl group.

It has been found that a treatment of the anodized workpiece with AC current prior to electrolytic coloring, employing an electrolyte solution comprising the said organic carboxylic acid compounds, permits obtainment of medium to light colors of aluminum, including colors in the blue and green range.

Examples of suitable organic carboxylic acid compounds include glycolic (hydroxyacetic), lactic (hydroxypropionic), malic (hydroxysuccinic), oxalic, pyruvic, and aminoacetic acids, and mixtures thereof. Glycolic acid is preferred in the present process.

It has been further found that the use of certain polyhydric alcohols together with the aforementioned organic carboxylic acid compounds in the AC-treatment step provides additional light and medium color tones, particularly including colors in the the blue and blue-gray range.

Therefore, in an embodiment of the process of the present invention, the AC-treatment electrolyte bath further comprises, in addition to the organic carboxylic acid compound or compounds, about 1 to 15 volume percent, and preferably 1–10 vol. %, of a polyhydric alcohol of 3 to 6 carbon atoms. Examples of suitable polyhydric alcohols are glycerol, butanediol-1,4, pentanediol-1,5, mannitol and sorbitol, of which glycerol is preferred.

Most preferably, the AC-treatment electrolyte bath comprises equal parts by volume, e.g., 1–10 volume % each, of the organic carboxylic acid and the polyhydric alcohol.

It has also been found that the desired light and medium colors of aluminum can be achieved when the organic carboxylic acid and/or polyhydric alcohol compounds which are employed in the AC-treatment step are also present in the anodization bath, and accordingly in an embodiment of the invention, a common bath may be used both for anodization and for the AC-treatment.

The preferred electrolyte for AC-treatment is sulfuric acid.

The voltage of the alternating current is about 5 to about 25 volts, preferably about 10–20 volts, more preferably about 12–18 volts, and most preferably about 12–15 volts to obtain colors in the blue range and 15–18 volts to obtain colors in the green range. Current is applied to the workpiece for about 1 to 25 minutes.

The wave form may, for example, be symmetric and/or asymmetric, pulsed anodic and/or cathodic with a square or sinusoidal output. The current may be applied continuously or non-continuously.

The AC-treatment bath is maintained at about 55°–90° F., preferably about 65°–75° F.

The thus-treated anodized aluminum workpiece is then subjected to electrolysis under generally known conditions to deposit one or more coloring agents into the pores of the anodic oxide film.

The electrolytic coloring bath comprises an aqueous strong acid, preferably sulfuric acid, in a concentration of about 5–50 g/l based on the total bath.

An alternating current is generally employed to deposit the coloring agent into the pores of the anodic oxide film. The applied voltage is generally in the range of from about 5 to about 25 volts, and preferably about 10–16 volts. The wave form is preferably sinusoidal.

Prior to electrolytic coloring, the workpiece is preferably subjected to an electrolytic "pre-treatment" which comprises application of a substantially direct anodic current thereto. This DC-pretreatment step has been found to provide product having improved color uniformity.

To effect such improvements, a current density of preferably about 0.5 ASF to about 5 ASF is maintained for about 0.5 minute to 10 minutes.

This direct current pre-treatment step may most conveniently be carried out in the electrolytic coloring solution but can also be carried out in a separate electrolytic bath having an acid concentration substantially equivalent to the acid concentration of the coloring solution.

After the DC-pretreatment step, the workpiece is then subjected to electrolysis by conventional means as described above employing a coloring agent in an aqueous electrolyte solution. Suitable coloring agents are metals such as nickel, cobalt, silver, copper, selenium, iron, molybdenum and tin, and the salts thereof, such as sulfates, nitrates, phosphates, hydrochlorides, oxalates, acetates and tartrates.

Additives such as aromatic sulfonic acids and organic thio-compounds may be used to aid in obtaining uniformity and depth of color.

Copper has been found useful as a coloring agent in the process of the present invention. An example of a copper bath which may be employed comprises:

| | g/l |
|---|---|
| Sulfuric acid | 10–25 |
| Copper sulfate | 5–15 |
| Magnesium sulfate | 0–25 |

Tin salts, optionally in combination with the sulfates or acetates of copper or nickel, are also desirably employed in the process.

A preferred electrolytic coloring bath which in the process of the present invention has been been found to provide anodized aluminum product in light to medium colors comprises the following formulation:

| | g/l |
|---|---|
| sulfuric acid | 5–50 |
| copper sulfate | 5–50 |
| stannous sulfate | 1–10 |
| tartaric acid | 1–10 |
| nickel acetate | 1–10 |
| boric acid | 1–10 |

A further preferred bath comprises:

| | g/l |
|---|---|
| sulfuric acid | 20 to 40 |
| copper sulfate | 10 to 25 |
| stannous sulfate | 5 to 10 |
| tartaric acid | 5 to 10 |
| nickel acetate | 5 to 10 |
| boric acid | 5 to 10 |

Varying colors of aluminum may be obtained depending on the conditions of anodization and electrolytic deposition.

For example, an aluminum workpiece having been anodized by direct current in an anodization bath at 68° F. comprising:

| | |
|---|---|
| sulfuric acid | 170 g/l |
| aluminum | 5 g/l |
| glycerine | 1.0% by vol. |
| glycolic acid | 1.0% by vol. |

at a voltage of 18 V for 40 minutes and at a current density of 15 ASF, which is then subjected to AC-treatment in the same bath at a voltage of 18 V for 5 minutes, followed by electrolytic coloring in a bath comprising the following formulation:

| | g/l |
|---|---|
| sulfuric acid | 10 |
| copper sulfate | 5 |
| stannous sulfate | 5 |
| tartaric acid | 5 |
| nickel acetate | 5 |
| boric acid | 20 |

at a voltage of 18 V, for 0.5 min., 1 minute, 2 and 3 minutes, respectively, has the following coloration as a function of duration of applied current in the electrolytic deposition step:

| duration of applied current (minutes) | color |
|---|---|
| 0.5 | light blue |
| 1.0 | blue |
| 2.0 | light green |
| 3.0 | dark green |

It has been found that deeper colors including those in the blue, blue-gray, green and green-gray range, are obtainable by maintaining a "waiting period" at one or more stages of the process, during which essentially no current is passed to the workpiece in the electrolyte solution.

The cumulative duration of the currentless waiting periods is preferably about 0.5 to 30 minutes.

Preferably such a waiting period is maintained following the AC-teatment step (b), and prior to the electrolytic coloring step (c), of the process of the invention.

For example, the workpiece, having been recovered from the AC-treatment solution of step (b), is then introduced into the electrolytic coloring solution of step (c) (or another solution having an acid strength substantially equivalent thereto), and maintained therein for a period of time during which essentially no current is passed to the workpiece, after which the workpiece is subjected to further electrolytic treatments according to the invention. In the case where a direct current pre-treatment of the workpiece is carried out prior to electrolytic coloring, as previously described herein, the currentless "waiting period" is generally effected prior to this DC pre-treatment step. (An additional such waiting period, generally about 0.5 minutes in duration, is also preferably maintained between the DC-pretreatment step and the electrolytic coloring step.)

More preferably, the workpiece, having been subjected to AC-treatment in the electrolytic solution of step (b) is then maintained in such solution (or in another solution having substantially equivalent acid strength thereto) for an initial currentless waiting period, and thereafter is transferred to the electrolytic coloring solution of step (c) (or another solution having substantially equivalent acid strength thereto), where one or more additional such currentless waiting periods are maintained, as described above, prior to electrolytic coloring according to step (c) of the invention. It is preferred in this case that the initial waiting period in the electrolytic solution of step (b) be about 1–20, and preferably 10–15, minutes in duration, and that the subsequent period or periods be about 4–10 minutes in cumulative duration. It has been observed that deepened colors of the resulting product, including deeper blue and blue-gray color tones at lower AC-treatment voltages and deeper green colors at higher AC-treatment voltages, can be obtained by lengthening the duration of the waiting period in the AC-treatment solution (or equivalent acid strength solution) within the above-recited ranges.

The provision of blue, green and other colors of anodized aluminum and aluminum alloy by the process of the invention responds to a long-felt need in the art, particularly as concerns architectural aluminum product.

Following electrolytic coloring, the pores in the anodic oxide film may be sealed by immersion in boiling water or by impregnation with wax-like substances, or by other means such as with chemical treatments, which are known in the art.

The process of the present invention can be applied to all aluminum and aluminum alloys which may be conventionally anodized and electrolytically colored. Such alloys are well-known and contain at least about 80%, and preferably at least about 95%, aluminum.

In each of the following examples, the aluminum workpiece comprises a panel of sheet stock type 1100 aluminum alloy about 10×15 cm., which has been pre-treated by degreasing with an alkaline cleaner, Anodal[7] NS1 powder, followed by immersion in aqueous 6% sodium hydroxide etching solution at 140° F. for about 5 minutes.

A 45-liter tank equipped with a power source and temperature control means which contains an electrolyte bath of the below-indicated composition, is used for anodization of the panel, and also for the subsequent AC-treatment. An 18-liter tank also equipped with a power source, containing an electrolytic coloring bath of the below-described composition, is employed in the coloring step. In the anodization tank, the panel is adapted to serve as the anode of the external power source, and six strips of aluminum extrusion alloy 6063T6, each approximately 2×25 cm, serve as counterelectrodes. The counterelectrodes are arrayed in two parallel rows equidistant from the panel on each side. The electrodes are completely immersed in the bath, current is then applied.

In each of the examples, anodization is performed by applying direct current to one of the panels at the current density and for the length of time also below-indicated.

Except where otherwise indicated, the panel is thereafter subjected to the AC-treatment step of the process, wherein alternating current is applied at the voltage and for the length of time indicated in column (b) on the accompanying Table I.

The panel is then removed from the tank, rinsed with water, and transferred to the electrolytic coloring bath, which has the below-recited composition. Current is applied to the panel at the Voltage and for a length of time recorded in column (c) of Table I.

The obtained colors of the panels are recorded in column (d) of Table I.

Table II provides the results of standard testing of certain of the panels for weatherability and corrosion resistance.

Unless otherwise indicated, the temperature of the baths is about 68°–72° F.

EXAMPLE 1–10

(a) Anodization (step (a)) is carried out employing a direct current voltage at a current density of 15 ASF for about 35 minutes in a bath as follows:

165 g./l sulfuric acid 6 g./l aluminum 2 vol. % glycolic acid (b) AC-treatment of the anodized workpiece (step (b)) is then carried out in the bath employed in step (a) under the current conditions given on Table I.

(c) Electrolytic coloring (step (c)) is conducted under the current conditions given on Table I in a bath comprising:

15 g./l sulfuric acid 10 g./l copper sulfate 20 g./l magnesium sulfate

Colors in the range of green-gray and blue-gray are obtained, with green generally predominating at the higher alternating current ranges, e.g., about 15 volts or above, and blue predominating at lower current ranges. Reddish colors are observed in Examples 9 and 10 following treatments in step (b) wherein current strength is about 6 volts; however, color tones in the blue and green range can be obtained at lower voltages by employing, e.g., increased acid concentration solutions, higher operating temperatures, etc.

Comparative Examples 11–12

The general procedure of Examples 1–10 is employed using baths of the same composition, under the current conditions indicated on Table I, except that no glycolic acid is present in the electrolytic bath used in steps (a) and (b).

Reddish colors are obtained.

EXAMPLE 13

The general procedure of Examples 1–10 is followed, an alternating current of 26 volts being employed in step (b). (In addition, 2 vol. % glycolic acid is added to the bath used in steps (a) and (b), providing a total of 4 vol. % glycolic acid in the bath.)

The product is poorly colored and exhibits spalling. However, the desired colors of the invention may be obtainable under the given voltage conditions by, e.g., lowering acid concentration, reducing temperature, etc.

EXAMPLES 14–28

(a) Anodization is carried out employing a direct current voltage of 18 V for 40 minutes at a current density of 15 ASF in a bath comprising:

| | |
|---|---|
| sulfuric acid | 170 g./l |
| glycolic acid | 2.0 vol. % |
| glycerine | 2.0 vol. % |
| aluminum | 5 g./l |

(b) AC-treatment of the anodized workpiece (step (b)) is then carried out in the bath employed in step (a) under the current conditions given on Table I.

(c) Electrolytic coloring is then carried out under the current conditions indicated on Table I in a bath comprising:

| | g/l |
|---|---|
| copper sulfate | 10 |
| stannous sulfate | 5 |
| nickel acetate | 5 |
| tartaric acid | 5 |
| boric acid | 5 |
| sulfuric acid | 20 |

Comparative Examples 29–33

The general procedure of steps (a) and (c) of Examples 19–28 is repeated employing the same electrolytic baths and the same current conditions for anodization. (The current conditions for electrolytic coloring (step (c)) are provided on Table I.) However, step (b) is omitted.

The resulting panels exhibit colors in the red to black color tones.

The resulting panels of Examples 14–28 and Comparative Examples 29–33 are then subjected to tests of weatherability and corrosion resistance as recorded on the accompanying Table II.

TABLE I

| (a) | (b) AC-Treatment Step Current (volts AC) | (b) AC-Treatment Step Duration (min.) | (c) Electrolytic Coloring Current (volts) | (c) Electrolytic Coloring Duration (min.) | (d) Color |
|---|---|---|---|---|---|
| Examples | | | | | |
| 1 | 15 | 10 | 18V-AC | 2 | dark green-gray |
| 2 | 16 | 20 | " | 1 | medium-dark green-gray |
| 3 | 15 | 5 | " | " | dark green-gray |
| 4 | 12 | " | " | " | medium blue-gray |
| 5 | 10 | " | " | " | light blue-gray |
| 6 | 20 | " | " | 0.5 | medium-light green-gray |
| 7 | " | " | 20V-AC | 1.0 | medium-dark green-gray |
| 8 | 24 | " | " | 0.5 | faint green w/spalling |
| 9 | 6 | " | 18V-AC | 2 | deep red |
| 10 | " | " | " | 4 | red-black |
| Comparative Examples | | | | | |
| 11 | 16 | 5 | 18V-AC | 1 | light red |
| 12 | " | " | " | 2 | rose |
| Examples | | | | | |
| 13 | 26 | 5 | 18V-AC | 4 | no color--spalling |
| 14 | 18 | " | " | 2 | light blue-gray |
| 15 | " | 10 | " | " | light green |
| 16 | " | 15 | " | 5 | light green, some spalling |
| 17 | 23 | 5 | " | 0.5 | light green |
| 18 | " | " | " | 2 | dark green |
| 19 | 23 | 5 | 18V-AC | 1 | medium green-gray |
| 20 | " | 10 | " | 0.5 | light green |
| 21 | " | " | " | 2 | medium green |
| 22 | " | " | " | 3 | dark green gray |
| 23 | 16 | 5 | " | 2 | light gray |
| 24 | " | " | " | 4 | medium blue-gray |
| 25 | 15 | " | " | 2 | medium blue-gray |
| 26 | " | " | " | 4 | blue-green-gray |
| 27 | 20 | 10 | " | 1 | green-gray |
| 28 | " | " | " | 3 | dark gray |
| Comparative Examples | | | | | |
| 29 | — | — | 16 V-DC | 15 | deep red |
| | | | 18 V-AC | 0.5 | light rose |
| | | | | 1.0 | light red |
| | | | | 2.0 | medium red |
| | | | | 3.0 | deep red |
| | | | | 5.0 | black |
| 30 | — | — | 16 V-DC | 2 | medium red |
| | | | 18 V-AC | 1 | light red |
| 31 | — | — | 18 V-AC | 5 | black |
| 32 | — | — | " | 1 | light red |
| 33 | — | — | " | 3 | deep red |

TABLE II

| | Note Corresponding to Grey Scale[1] % Loss of Color | Note Corresponding to Grey Scale[1] Observed Color Change | Weight Loss[2] mg/dm$^2$ | Admittance[3] (μS) | Corrosion Resistance[4] |
|---|---|---|---|---|---|
| Examples | | | | | |
| 23 | <10 | Brighter | 2.6 | 11.0 | 10 (No Attack) |
| 24 | <10 | " | 5.0 | 7.5 | 10 (No Attack) |
| 25 | <10 | " | 2.8 | 11.5 | 10 (No Attack) |
| 26 | 10 | " | 2.2 | 8.0 | 10 (No Attack) |
| 27 | <10 | " | 3.2 | 12.5 | 10 (No Attack) |
| 28 | <10 | " | 3.4 | 12.0 | 10 (No Attack) |

TABLE II-continued

| | Note Corresponding to Grey Scale[1] | | | | |
|---|---|---|---|---|---|
| | % Loss of Color | Observed Color Change | Weight Loss[2] mg/dm$^2$ | Admittance[3] (μS) | Corrosion Resistance[4] |
| Comparative Examples | | | | | |
| 32 | 10 | Darker | 2.6 | 8.5 | 10 (No Attack) |
| 33 | 10 | Darker | 4.0 | 12.5 | 10 (No Attack) |

[1]Panels tested on Atlas Weather-O-meter 65 WRC for 7,000 hours of total exposure. The numeral "10" indicates a loss of color of about 10%. The observed change in color of the panel after testing, whether brighter or darker, is also indicated.
[2]Procedure of ISO 3210-1983(E): - Assessment of quality of anodic oxide film by measurement of loss of mass after immersion in phosphoric-chromic acid solution.
[3]Admittance value (μS) obtained according to the procedure of ISO 2931-1983(E).
[4]Results of Copper-accelerated acetic acid salt spray (CASS) test (ISO-3770-1976(E)).

EXAMPLES 34–37

General Procedure (a) Employing the apparatus initially described above, anodization of the workpiece is carried out by applying direct current to the panel at a current density of 15 ASF for about 35 minutes in a bath comprising:

165 g./l sulfuric acid 6 g./l aluminum 2.0 vol % glycolic acid 2.0 vol % glycerine (b) AC-treatment of the anodized workpiece is then carried out in the same bath employed in step (a) by passing 14 volts for 10 minutes.

(c) The panel is then removed from the anodization tank, rinsed with water, and transferred to an electrolytic coloring bath, which comprises:

15 g./l sulfuric acid 10 g./l copper sulfate 20 g./l magnesium sulfate

Alternating current is passed at a voltage of 14 volts for 2 minutes.

EXAMPLE 34

(i) Prior to application of alternating current in step (c) above, the panel is maintained in the coloring bath for a currentless "waiting period" of 20 minutes.

The color of the resulting panel is a deep blue.

EXAMPLE 35

(i) Following the AC-treatment according to step (b) above, the workpiece is maintained in the electrolyte solution used in step (b) for a currentless "waiting period" of 5 minutes. The workpiece is then removed from the anodization bath and transferred to the coloring bath.

(ii) Prior to application of alternating current in step (c) above, the panel is maintained in the coloring bath for a currentless "waiting period" of 10 minutes.

The resulting panel is observed to have a somewhat deeper blue coloration than the panel of Example 34.

EXAMPLE 36

The procedure of Example 35 is repeated, with the exception that the aluminum workpiece comprises a panel of 6063-T6 aluminum alloy about 2"×20;" the coloring tank comprises a 7-liter tank having dimensions 6"×6"×24"; and the counterelectrodes comprise 2 rods of stainless steel, ¼" diameter, 6" in length, which are placed about ½" from one end of the tank. Thus current density applied to the workpiece in the electrolytic coloring step (c) of the process varies depending on distance from the counterelectrodes.

The resulting workpiece exhibits an intense blue color in the higher current density zone (i.e. nearest the counterelectrodes) and a lighter blue color in the low current density zone (furthest from the counterelectrodes).

EXAMPLE 37

The procedure of Example 36 is followed, except that after subjecting the anodic workpiece to a currentless waiting time of 10 minutes in the coloring tank, and prior to application of AC current for electrolytic coloring under the conditions of Example 35, a direct current of 16 V is applied to the workpiece for 2 minutes, and the workpiece is then subjected to a currentless "waiting time" of 0.5 minute.

The resulting panel shows greater unifomity of blue color, indicating that improved throwing power is obtained as a result of application of direct current in the electrolytic coloring bath prior to application of alternating current. A green color is also observed in the high current density zone.

EXAMPLE 38

Steps (a), (b) and (c) of the General Procedure described for Examples 34–37 are carried out, employing the apparatus initially described herein, with the exception that the workpiece and coloring tank apparatus are as described in Example 36. The following additional steps are carried out following step (b) (AC-treatment) and prior to step (c) (electrolytic coloring) of the General Procedure, in the order below-indicated:

(i) Following step (b), a panel is maintained in the AC-treatment bath of step (b) for a currentless waiting time period having a duration of either of 0 min.; 2 min.; 10 min.; or 20 min.

(ii) The panel is then transferred to the coloring bath where it is maintained for a currentless "waiting period" of 5 minutes.

(iii) A direct current of 16 V is then applied to the workpiece for 2 minutes;

(iv) The workpiece is subjected to a currentless "waiting time" of 0.5 minute; and step (c) is then carried out.

A primarily light blue color of the resulting product is obtained with good color uniformity in the absence of a waiting period in step (i). It was observed that deeper colors, including predominantly deep blue colors, can be obtained by lengthening the waiting period of step (i) from 0 to 20 minutes.

EXAMPLE 39

The procedure of Example 38 is carried out, with the exception that in the AC-treatment step (b), an alternating current of 18 volts is employed.

A primarily light greenish-blue color of the resulting product with good color uniformity is obtained in the absence of a waiting period in step (i). It was observed that deeper greenish colors can be obtained by lengthening the waiting period of step (i) from 0 to 20 minutes.

The above Examples demonstrate that desirable colors of anodized aluminum and aluminum alloy may be obtained by the process of the invention, and that the thus-prepared colored anodic oxide film has satisfactory corrosion resistance and weatherability.

Of course, various changes and modifications may be made without departing from the invention and it is intended, therefore, that all matter contained in the foregoing description shall be interpreted as illustrative only and not limitative of the invention.

What is claimed is:

1. A process for electrolytically coloring aluminum or an aluminum alloy comprising:

a. anodozing an aluminum or aluminum alloy workpiece in an aqueous electrolyte solution comprising 90–300 grams per liter of sulfuric acid by application of direct current at a current density of 10 to 20 amperes per square foot and a temperature of from 55° F. to 90° F. to form on the workpiece a porous anodic oxide film having a thickness of at least about 3 microns;

b. subjecting the resulting anodized workpiece to alternating current at a voltage of about 5 to about 25 volts for about 1 to 25 minutes at a temperature of about 55° F. to 90° F. in an aqueous electrolyte solution comprising 120–250 grams per liter of sulfuric acid, from about 1 to 15 volume percent of an organic carboxylic acid containing at least one reactive group in the alpha-position, wherein said reactive group is a hydroxy, amino, keto or carboxyl group, and about 1 to 15 volume percent of a polyhydric alcohol having 3 to 6 carbon atoms; and c. electrolytically coloring the workpiece by subjecting it to substantially alternating current in an aqueous electrolyte solution comprising at least one metal salt as a coloring agent.

2. A process according to claim 1 wherein steps (a) and (b) are carried out in the same bath.

3. A process according to claim 1 wherein the organic carboxylic acid is selected from the group consisting of glycolic acid, lactic acid, malic acid, oxalic acid, pyruvic acid, aminoacetic acid, and mixtures thereof.

4. A process according to claim 3 wherein the organic carboxylic acid is glycolic acid.

5. A process according to claim 1 wherein the polyhydric alcohol is selected from the group consisting of glycerol, butanediol-1,4, pentanediol-1,5, mannitol and sorbitol.

6. A process according to claim 5 wherein the polyhydric alcohol is glycerol.

7. A process according to claim 1 wherein in step (b) the aqueous electrolyte solution comprises 1–10 volume percent glycolic acid and 1–10 volume percent glycerol.

8. A process according to claim 7 wherein the aqueous electrolyte solution comprises equal parts by volume of glycolic acid and glycerol.

9. A process according to claim 1 wherein the porous anodic oxide film has a thickness of about 20–30 microns.

10. A process according to claim 1 wherein the coloring agent comprising a copper salt.

11. A process according to claim 1 wherein in step (c) the electrolytic coloring solution comprises:

| | g/liter of solution |
|---|---|
| sulfuric acid | 5 to 50 |
| copper sulfate | 5 to 50 |
| stannous sulfate | 1 to 10 |
| tartaric acid | 1 to 10 |
| nickel acetate | 1 to 10 |
| boric acid | 1 to 10. |

12. A process according to claim 11 wherein the solution comprises:

| | g/liter of solution |
|---|---|
| sulfuric acid | 20 to 40 |
| copper sulfate | 10 to 25 |
| stannous sulfate | 5 to 10 |
| tartaric acid | 5 to 10 |
| nickel acetate | 5 to 10 |
| boric acid | 5 to 10. |

13. A process according to claim 1 wherein the electrolytic coloring solution comprises:

| | g/l of solution |
|---|---|
| Sulfuric acid | 10–25 |
| Copper sulfate | 5–15. |

14. A process according to claim 1 wherein in step (a) the current density is 15–20 ASF, and in step (b) the voltage is 12–18 volts.

15. A process according to claim 1 wherein following step (b), the workpiece is subjected to a currentless waiting period.

16. A process according to claim 15 wherein said waiting period has a duration of about 0.5 to 30 minutes.

17. A process according to claim 15 wherein said waiting period is maintained at least in part in the electrolytic coloring solution of step (c) or another solution having substantially the same acid concentration prior to electrolytic coloring with alternating current.

18. A process according to claim 17 wherein following said waiting period and prior to electrolytic coloring with alternating current, direct current is applied to the workpiece in the electrolytic coloring solution or another solution having substantially the same acid concentration.

19. A process according to claim 17 wherein prior to said waiting period in the electrolytic coloring solution or another solution having substantially the same acid concentration, the workpiece is subjected to a currentless waiting period in the AC-treatment solution of step (b) or another solution having substantially the same acid concentration.

20. A process according to claim 1 wherein prior to electrolytic coloring according to step (c), direct current is applied to the workpiece in the electrolytic coloring solution or another solution having substantially the same acid concentration.

21. A process according to claim 20 wherein said direct current applied prior to electrolytic coloring is applied at a current density of about 0.5 to about 5 ASF for 0.5 to about 10 minutes.

22. A process according to claim 20 wherein following application of said direct current applied prior to electrolytic coloring and prior to the electrolytic coloring step (c), the workpiece is subjected to a currentless waiting period in the electrolytic coloring solution or another solution having substantially the same acid concentration.

23. A process for electrolytically coloring aluminum or an aluminum alloy comprising:

a. anodizing an aluminum or aluminum alloy workpiece in an aqueous strong acid solution comprising 120–250 grams per liter of sulfuric acid by application of direct current at a current density of 10 to 20 amperes per square foot and a temperature of from 55° F. to 90° F. to form on the workpiece a porous anodic oxide film having a thickness of at least about 3 microns;

b. subjecting the resulting anodized workpiece to alternating current at a voltage of about 10 to about 25 volts for about 1 to 25 minutes at a temperature of about 55° to 90° F. in an aqueous strong acid solution comprising 120–250 grams per liter of sulfuric acid and from about 1 to 10 volume percent of glycolic acid and from about 1–10 volume percent of glycerol; and c. electrolytically coloring the workpiece by subjecting it to substantially alternating current in an aqueous electrolyte solution comprising a copper salt.

24. A process for electrolytically coloring aluminum or an aluminum alloy comprising:

a. anodizing an aluminum or aluminum alloy workpiece in an aqueous electrolyte solution comprising 90–300 grams per liter of sulfuric acid by application of direct current at a current density of 10 to 20 amperes per square foot and a temperature of from 55° F. to 90° F. to form on the workpiece a porous anodic oxide film having a thickness of at least about 3 microns;

b. subjecting the resulting anodized workpiece to alternating current at a voltage of about 5 to about 25 volts for about 1 to 25 minutes at a temperature of about 55° to 90° F. in an aqueous electrolyte solution comprising 120–250 grams per liter of sulfuric acid and from about 1 to 15 volume percent of an organic carboxylic acid containing at least one reactive group in the alpha-position, wherein said reactive group is a hydroxy, amino, keto or carboxyl group;

c. subjecting the workpiece to a currentless waiting period in the aqueous electrolyte solution of step (b) or another solution having substantially the same acid concentration; and d. electrolytically coloring the workpiece by treating it with substantially alternating current in an aqueous electrolyte solution comprising a metal salt, said alternating current treatment being preceded by the steps of:

i. subjecting the workpiece to a currentless waiting period in the aqueous electrolyte coloring solution or another solution having substantially the same acid concentration; and ii. applying direct current to the workpiece in said solution at a current density of about 0.5 to about 5 ASF for about 0.5 for about 10 minutes.

25. An electrolytic coloring solution comprising:

| | g/liter of solution |
|---|---|
| sulfuric acid | 5 to 50 |
| copper sulfate | 5 to 50 |
| stannous sulfate | 1 to 10 |
| tartaric acid | 1 to 10 |
| nickel acetate | 1 to 10 |
| boric acid | 1 to 10. |

* * * * *